US009470377B1

(12) United States Patent
Osawa

(10) Patent No.: US 9,470,377 B1
(45) Date of Patent: Oct. 18, 2016

(54) LED LAMP

(71) Applicant: IRIS OHYAMA INC., Sendai-Shi, Miyagi (JP)

(72) Inventor: Hideharu Osawa, Kyoto (JP)

(73) Assignee: IRIS OHYAMA INC., Miyagi (JP)

( * ) Notice: Subject to any disclaimer, the term of this patent is extended or adjusted under 35 U.S.C. 154(b) by 0 days.

(21) Appl. No.: 15/227,526

(22) Filed: Aug. 3, 2016

Related U.S. Application Data

(63) Continuation of application No. 14/323,574, filed on Jul. 3, 2014, now Pat. No. 9,435,494, which is a continuation of application No. 13/943,212, filed on Jul. 16, 2013, now Pat. No. 9,121,552, which is a continuation of application No. 12/995,065, filed as application No. PCT/JP2009/060838 on Jun. 15, 2009, now Pat. No. 8,500,303.

(30) Foreign Application Priority Data

Jun. 17, 2008 (JP) ..... 2008-157699

(51) Int. Cl.
*F21V 19/02* (2006.01)

(52) U.S. Cl.
CPC ..... *F21K 9/272* (2016.08); *F21K 9/275* (2016.08); *F21V 19/02* (2013.01)

(58) Field of Classification Search
CPC ..... H01R 33/08; H01R 31/06
USPC ..... 362/217.01, 219, 220, 221, 227, 362/249.01–249.03, 249.1, 249.14, 551, 362/555, 649, 651, 652; 439/226, 239
See application file for complete search history.

(56) References Cited

U.S. PATENT DOCUMENTS

| | | | |
|---|---|---|---|
| 7,052,171 | B1 | 5/2006 | Lefebvre |
| 8,232,724 | B2 | 7/2012 | Mostoller |
| 8,500,303 | B2 | 8/2013 | Osawa |
| 2007/0133202 | A1 | 6/2007 | Huang et al. |
| 2013/0301269 | A1 | 11/2013 | Osawa |

FOREIGN PATENT DOCUMENTS

| | | |
|---|---|---|
| JP | U-H06-54103 | 7/1994 |
| JP | 3118932 U | 1/2006 |
| JP | 3119578 U | 2/2006 |
| JP | 3126462 U | 10/2006 |
| JP | 2007-207768 | 8/2007 |

*Primary Examiner* — Andrew Coughlin
*Assistant Examiner* — Meghan Ulanday
(74) *Attorney, Agent, or Firm* — Hamre, Shumann, Mueller & Larson, P.C.

(57) ABSTRACT

An LED lamp A1 includes an LED unit 1 in the shape of a straight tube with a plurality of LED modules 12 fixed therein, and also includes a pair of bases 2 that receive electric power from outside and are attached to the ends of the LED unit 1 spaced in the longitudinal direction of the LED unit. The LED unit 1 and the bases 2 are rotatable relative to each other about an axis extending in the longitudinal direction. With this arrangement, the direction of light emission can be changed, with the LED lamp attached to a general-use fluorescent lighting fixture.

2 Claims, 5 Drawing Sheets

LED LAMP

TECHNICAL FIELD

The present invention relates to an LED lamp that uses an LED as the light source and that is suitable for use as a substitute for a fluorescent lamp.

BACKGROUND ART

FIG. 5 shows a conventional LED lamp in a sectional view (see Patent Document 1 for example). The LED lamp X illustrated in the figure includes a substrate 91 in the shape of an elongated rectangle, a plurality of LEDs 92 mounted on the substrate 91, a tube 93 accommodating the substrate 91, terminals 94, and a circuit 95 for lighting the LEDs 92. The substrate 91 is formed with a wiring (not shown) that electrically connects the LEDs 92 and the terminals 94 to each other. When the terminals 94 are fitted into insertion ports of sockets of a general-use fluorescent lighting fixture, the LEDs 92 can be turned on. Since LEDs 92 have lower power consumption and a longer life, the use of LED lamp X as a substitute for a fluorescent lamp is expected to provide advantages in terms of the cost and environment.

The general-use fluorescent lighting fixture herein refers to lighting fixtures commonly used for interior lighting as the main application, and more specifically, lighting fixtures which use, for example in Japan, a commercial 100-volt power supply and to which a JIS C7617 straight-tube fluorescent lamp or a JIS C7618 circular fluorescent lamp can be attached.

Fluorescent lamps emit light from the entire circumference of the tube. In contrast, in the LED lamp X, the light from the LEDs 92 have a relatively high directivity. Therefore, depending on the orientation of the LED lamp X in the state attached to a fluorescent lighting fixture, a desired region may not be properly illuminated with light.

Patent Document 1: JP-U-6-54103

DISCLOSURE OF THE INVENTION

Problems to be Solved by the Invention

The present invention is proposed under the circumstances described above. It is therefore an object of the present invention to provide an LED lamp that can change the emission direction of light in the state attached to a general-use fluorescent lighting fixture.

Means for Solving the Problems

To solve the above-described problems, the present invention takes the following technical measures.

An LED lamp includes: an LED unit in the shape of a straight tube including a plurality of light emitting diodes fixed in the LED unit; and a pair of bases provided for receiving electric power from outside and attached to the ends of the LED unit that are spaced from each other in the longitudinal direction. The LED unit and the bases are rotatable relative to each other about a first axis extending in the longitudinal direction.

The LED lamp may further include a rotational shaft connecting the LED unit and the bases to each other and fitted to at least either the LED unit or the bases for rotation relative thereto.

The LED unit and the bases may be electrically connected to each other via a wiring cable arranged to extend through an internal space of the rotational shaft.

One of the LED unit and each base may be provided with a shaft having a center axis corresponding to the first axis, while the other may be provided with a cylindrical shaft in which the shaft is fitted. A conductive film formed on the outer circumferential surface of the shaft is in contact with a conductive film formed on the inner circumferential surface of the cylindrical shaft.

One of the LED unit and each base may be provided with an annular conductive member having a center corresponding to the first axis, while the other is provided with a conductive member held in contact with the annular conductive member.

Other features and advantages of the present invention will become more apparent from the detailed description given below with reference to the accompanying drawings.

BEST MODE FOR CARRYING OUT THE INVENTION

Preferred embodiments of the present invention are described below with reference to the drawings.

Figure 1:
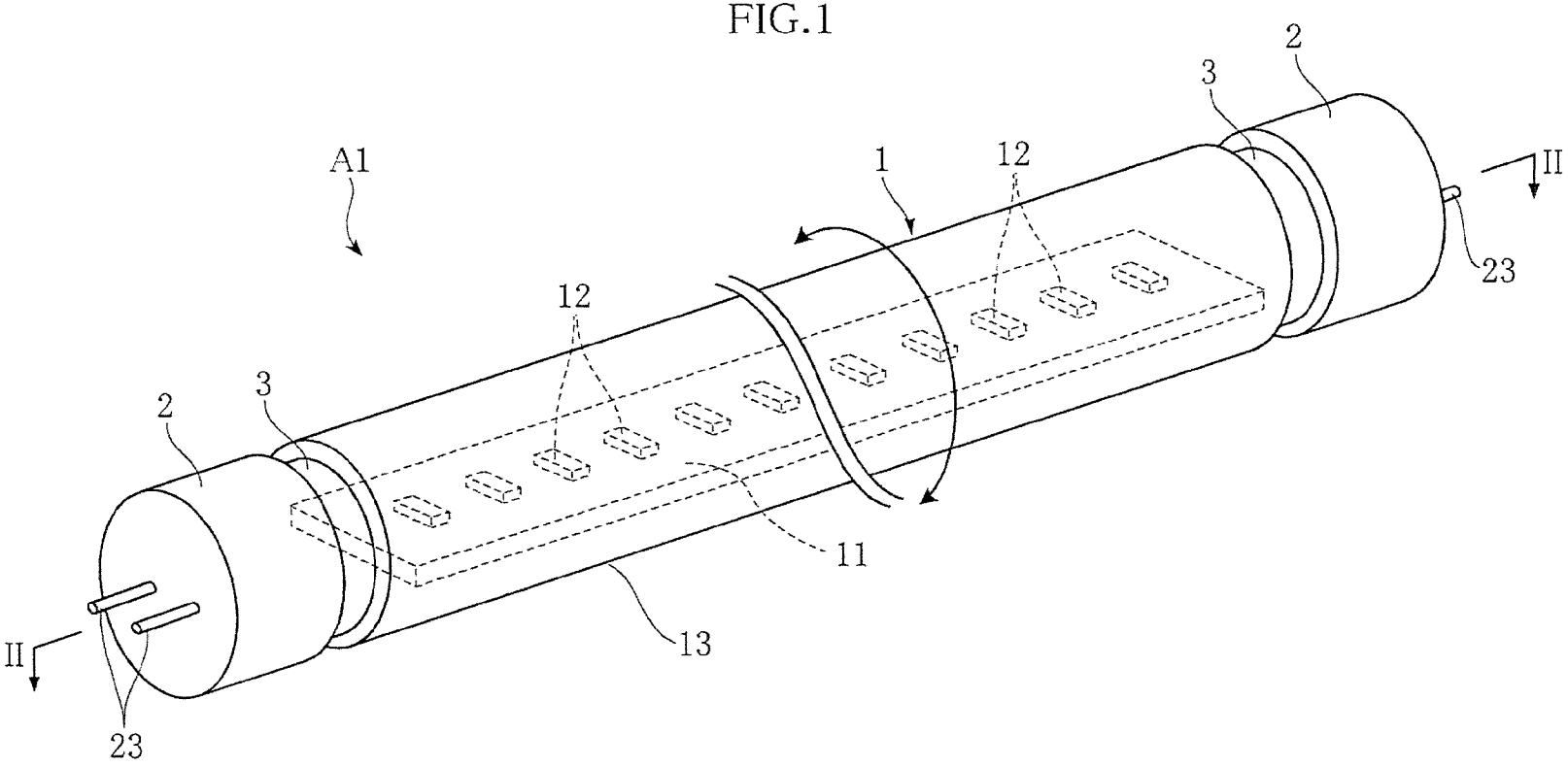
FIG. 1 is a perspective view showing an LED lamp according to a first embodiment of the present invention.
Figure 2:
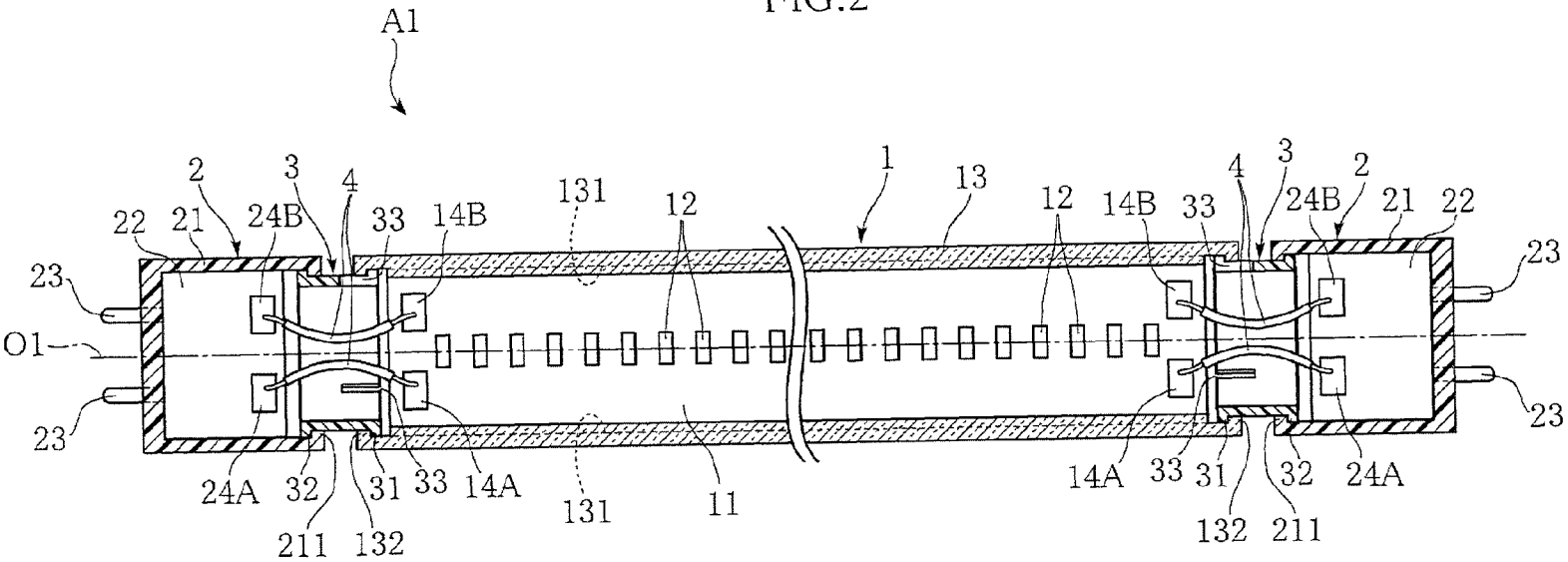
FIG. 2 is a sectional view taken along lines II-II in FIG. 1.

FIGS. 1 and 2 show an LED lamp according to a first embodiment of the present invention. The LED lamp A1 of this embodiment includes an LED unit 1 in the shape of a straight tube, a pair of bases 2 and rotational shafts 3. For instance, the LED lamp is used as attached to a general-use fluorescent lighting fixture, as a substitute for a straight-tube fluorescent lamp.

The LED unit 1 includes a substrate 11 in the shape of an elongated rectangle, a plurality of LED modules 12 mounted on the substrate 11, and a cylindrical case 13 accommodating the substrate 11. The substrate 11 is fixed to the case 13 by e.g. fitting the longitudinally extending edges of the substrate into engagement grooves 131 formed at the inner circumference of the case 13. As the LED modules 12, e.g. a white, packaged LED is suitably used. The plurality of LED modules 12 are connected in series to each other by e.g. a wiring, not shown. A pair of terminals 14A and 14B, which are electrically connected to the wiring, are provided at each end of the substrate 11 in the longitudinal direction.

The paired bases 2 are portions to be mounted to the sockets of a fluorescent lighting fixture to allow power supply from a commercial AC power supply to the LED unit 1, and attached to the ends of the LED unit 1 in the longitudinal direction via rotational shafts 3. Each of the bases 2 includes a cylindrical cover 21, a circuit board 22 accommodated in and held by the cover 21, and two external connection terminals 23. The cover 21 comprises a single-piece member made by e.g. bonding an upper half piece and a lower half piece together. The circuit board 22 includes a drive circuit for lighting the LED modules 12 and a wiring (neither is shown). A pair of terminals 24A and 24B, which are electrically connected to the wiring, are provided at an end of the circuit board 22.

The rotational shaft 3 is cylindrical as a whole and connects the LED unit 1 and the base 2 rotatably relative to each other. The rotational shaft 3 is formed with engagement portions 31, 32 and a plurality of slits 33. For instance, the engagement portions 31 and 32 project radially outward from the ends of the rotational shaft 3. The slits 33 are provided at the end where the engagement portion 31 is formed and extend along the axis O1. An engagement portion 132 projecting radially inward is provided at an end of the case 13 of the LED unit 1, while an engagement portion 211 projecting radially inward is provided at an end of the cover 21 of the base 2.

With this structure, the engagement portions 132 and 31 engage each other to prevent the rotational shaft 3 from coming off the LED unit 1, while allowing the LED unit 1 and the rotational shaft 3 to be rotatable relative to each other about the axis O1. Also, the engagement portions 211 and 32 engage each other to prevent the rotational shaft 3 from coming off the base 2, while allowing the base 2 and the rotational shaft 3 to be rotatable relative to each other about the axis O1. In this way, the LED unit 1 and the base 2 are connected via the rotational shaft 3 rotatably relative to each other about the axis O1. Since the rotational shaft 3 is provided with slits 33, the end where the engagement portion 31 is formed can reduce its diameter, which allows insertion and removal of the rotational shaft 3 relative to the LED unit 1.

A pair of wiring cables 4, for example, are arranged to extend through an internal space of the rotational shaft 3. The wiring cables 4 comprise e.g. a conductive wire covered with an insulating material, and are bendable and twistable. The ends of the wiring cables 4 are electrically connected to the terminals 14A, 14B on the substrate 11 and terminals 24A, 24B on the circuit board 22. The wiring cables 4 are attached with appropriate slack, which allows rotation of the LED unit 1 and the base 2 relative to each other within a predetermined angular range (e.g. through about 90° in each rotational direction relative to the neutral state shown in FIG. 2, and hence through about 180° in total).

The advantages of the LED lamp A1 having the above-described structure are described below.

To use the LED lamp A1, the external connection terminals 23 of the bases 2 are fitted into the inlet ports of the sockets of a fluorescent lighting fixture. By supplying electric power to the LED unit 1 through the wiring cables 4, LED modules 12 can be turned on.

When the LED lamp A1 is mounted to a fluorescent lighting fixture, the bases 2 are not rotatable relative to the lighting fixture, because the two external connection terminals 23 of each base 2 are fitted into the socket. However, the LED unit 1 is rotatable relative to the bases 2. Thus, with the LED lamp A1 of the present embodiment, the emission direction of the light from the LED modules 12, which are fixed in the LED unit 1, can be changed appropriately, whereby illumination of a desired region with light is ensured.

Each socket of a fluorescent lighting fixture includes two inlet ports for receiving the external connection terminals 23 of the LED lamp A1. It is now assumed that a fluorescent lighting fixture is attached to a ceiling, and the two inlet ports of each socket of this fluorescent lighting fixture are vertically spaced apart from each other. In this case, when the LED lamp A1 in such a state as shown in FIGS. 1 and 2 is mounted to the lighting fixture, light is emitted substantially in the horizontal direction. However, by rotating the LED unit 1, the light can be directed downward.

In the LED lamp A1 of the present embodiment, the LED unit 1 and each base 2 are connected via the rotational shaft 3. This arrangement ensures smooth rotation of the LED unit 1 and the base 2 relative to each other. The LED unit 1 and the base 2 are electrically connected to each other via the wiring cables 4 extending internally through the rotational shaft 3. Thus, the electrical connection is properly maintained even when the LED unit 1 and the base 2 are rotated relative to each other.

Figure 3:
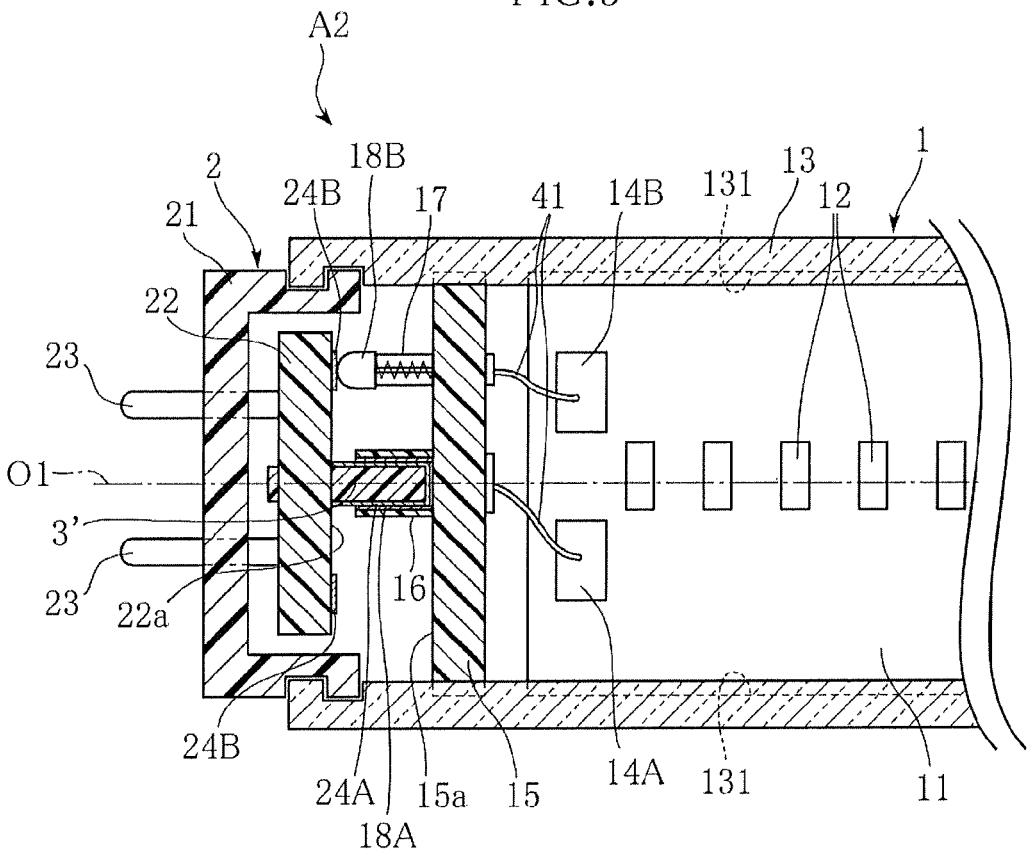
FIG. 3 is a sectional view showing an LED lamp according to a second embodiment of the present invention.
Figure 4:
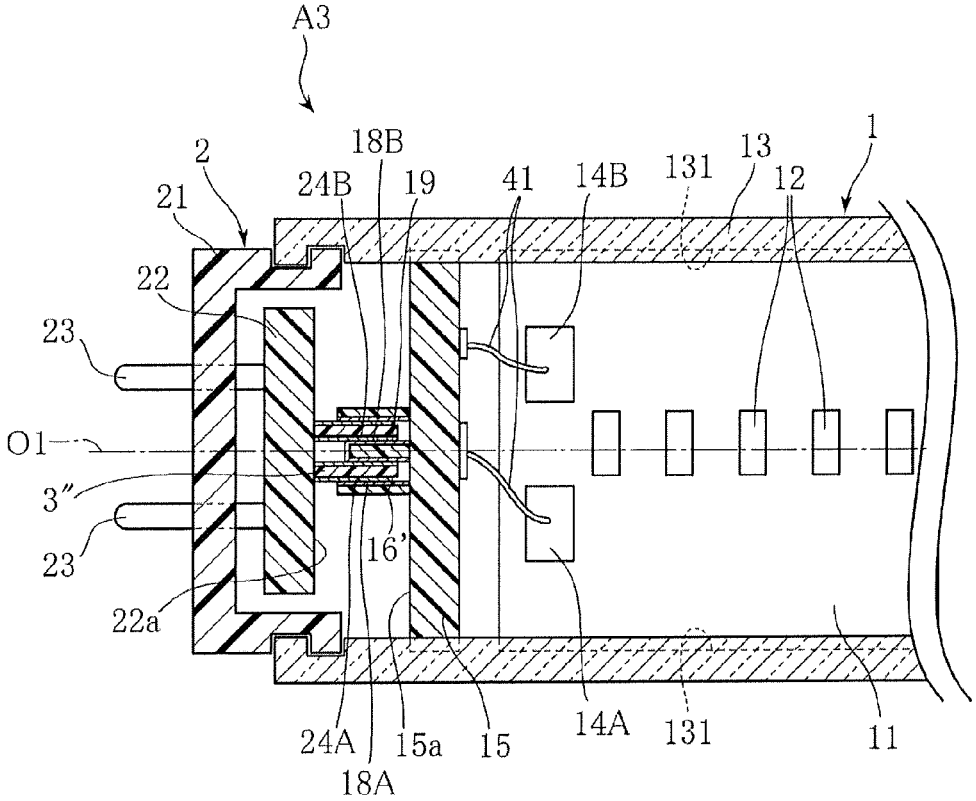
FIG. 4 is a sectional view showing an LED lamp according to a third embodiment of the present invention.
Figure 5:
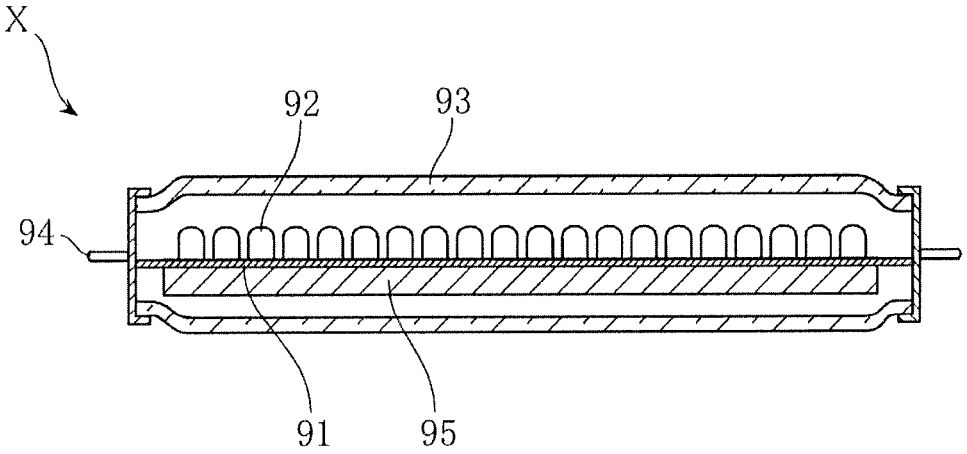
FIG.5 Prior Art
FIG. 5 is a sectional view showing a conventional LED lamp.

FIGS. 3 and 4 show other examples of an LED lamp according to the present invention. In these figures, the elements that are identical or similar to those of the foregoing embodiment are designated by the same reference signs as those used for the foregoing embodiment, and the description is appropriately omitted.

FIG. 3 shows an LED lamp according to a second embodiment of the present invention. The LED lamp A2 of this embodiment is different from the LED lamp A1 of the foregoing embodiment in connecting structure of the LED unit 1 and the bases 2. Specifically, an additional substrate 15 is provided at each end of the substrate 11 of the LED unit 1 in the longitudinal direction. The substrate 15 is disposed in such a manner that its in-plane direction is perpendicular to the axis O1. The circuit board 22 of the base 2 is disposed to face the substrate 15.

A cylindrical shaft 16 and an elastic conductive member 17 are provided on the substrate 15 at the surface 15*a* that faces the circuit board 22. The center axis of the cylindrical shaft 16 corresponds to the axis O1. The cylindrical shaft 16 is provided with a terminal 18A, which comprises e.g. a metal film, on the inner surface. The terminal 18A is electrically connected to the terminal 14A of the substrate 11 via a wire 41 and so on. The elastic conductive member 17 is located at a position spaced apart from the axis O1 by a predetermined distance. The elastic conductive member 17 comprises a spring probe or a leaf spring, for example. The elastic conductive member 17 is provided with a terminal 18B at an end. The terminal 18B is electrically connected to the terminal 14B of the substrate 11 via a wire 41 and so on, and is constantly urged toward the circuit board 22 by the elastic conductive member 17. The case 13 of the LED unit 1 comprises a single-piece member made by e.g. bonding an upper half piece and a lower half piece together, and the substrates 11 and 15 are held by the case 13 integrally on the case. The case 13 and the cover 21 of the base 2 are connected to be rotatable relative to each other.

A rotational shaft 3' and a terminal 24B are provided on the circuit board 22 at the surface 22*a* that faces the substrate 15. The rotational shaft 3' has a center axis corresponding to the axis O1, and is provided with a terminal 24A, which comprises e.g. a metal film, on the outer surface. The rotational shaft 3' is fitted in the cylindrical shaft 16 of the substrate 15 for rotation relative to each other. With this arrangement, the terminal 24A and the terminal 18A are constantly held in contact with each other. The terminal 24B is located at a position spaced apart from the axis O1 by a predetermined distance, and comprises e.g. an annular metal film. Against the terminal 24B, the elastic conductive member 17 presses the terminal 18B for contact with the terminal 24B. With this arrangement, the terminal 24B and the terminal 18B are constantly held in contact with each other even when the cylindrical shaft 16 and the rotational shaft 3 are rotated relative to each other.

As will be understood from the foregoing description, the LED lamp A2 does not have a limit on the angle of rotation of the LED unit 1 relative to the bases 2. Thus, with the LED lamp A2, the emission direction of the light from the LED modules 12, which are incorporated in the LED unit 1, is more freely adjustable, which is convenient.

FIG. 4 shows an LED lamp according to a third embodiment of the present invention. The LED lamp A3 of this embodiment is different from the LED lamp A2 of the foregoing embodiment in electrical connection structure of the substrate 15 of the LED unit 1 and the circuit board 22 of the base 2. Specifically, an outer cylindrical shaft 16' and a pin 19 are provided on the surface 15*a* of the substrate 15. The outer cylindrical shaft 16' has a cylindrical shape having a center axis corresponding to the axis O1, and is provided with a terminal 18A on the inner surface. The pin 19 has a center axis corresponding to the axis O1, and is provided with a terminal 18B on the outer surface. A rotational shaft 3" is provided on the surface 22*a* of the circuit board 22. The rotational shaft 3" has a cylindrical shape having a center axis corresponding to the axis O1, and is provided with a terminal 24A on the outer surface and a terminal 24B on the inner surface.

The outer cylindrical shaft 16', the pin 19 and the rotational shaft 3" constitute a structure similar to that of a DC plug jack. That is, in the state where the rotational member 3" is fitted between the outer cylindrical shaft 16' and the pin 19, the terminal 18A and the terminal 24A are constantly held in contact with each other, while the terminal 18B and the terminal 24B are constantly held in contact with each other. The outer cylindrical shaft 16' and the pin 19 are rotatable relative to the rotational shaft 3".

As will be understood from above, the LED lamp A3 does not have a limit on the angle of rotation of the LED unit 1 relative to the bases 2. Thus, with the LED lamp A3, the emission direction of the light from the LED modules 12, which are incorporated in the LED unit 1, is more freely adjustable, which is convenient.

The LED lamp according to the present invention is not limited to the foregoing embodiments. The specific structure of each part of the LED lamp according to the present invention may be varied in design in various ways.

The invention claimed is:

1. An LED lamp comprising:

an LED unit including a straight tube and a plurality of light emitting diodes disposed in the straight tube;

a base for receiving electric power from outside of the LED lamp;

a flexible wiring cable arranged between the LED unit and the base; and a rotational shaft formed separate from the straight tube and the base;

wherein the base is attached via the rotational shaft to an end of the LED unit in a longitudinal direction of the LED unit, the rotational shaft connects the LED unit to the base and is attached to at least one of the LED unit and the base for rotation relative thereto, the LED unit and the base are rotatable relative to each other about a first axis extending in the longitudinal direction, and the wiring cable extends through an internal space of the rotational shaft with slack that allows rotation of the LED unit and the base relative to each other within a predetermined angular range about the first axis.

2. The LED lamp according to claim 1, wherein the wiring cable electrically connects the LED unit and the bases to each other.

* * * * *